US005156635A

United States Patent [19]

Snow, Jr.

[11] Patent Number: 5,156,635

[45] Date of Patent: Oct. 20, 1992

[54] BICYCLE WHEEL STRAIGHTENER

[76] Inventor: William E. Snow, Jr., 122 S. Curry St., Hampton, Va. 23663

[21] Appl. No.: 790,565

[22] Filed: Nov. 12, 1991

[51] Int. Cl.[5] ..... B21H 1/10

[52] U.S. Cl. ..... 72/110; 72/133

[58] Field of Search ..... 29/894.324, 894.33, 29/894.35, 894.354; 72/86, 87, 109, 110, 111, 133, 160, 164; 157/1.5

[56] References Cited

U.S. PATENT DOCUMENTS

| | | | |
|---|---|---|---|
| 575,554 | 1/1897 | Owen | 157/1.5 |
| 751,166 | 2/1904 | Gorton | 72/109 |
| 852,829 | 5/1907 | Einfeldt . | |
| 1,606,489 | 11/1926 | Winter . | |
| 1,650,216 | 11/1927 | Ingham . | |
| 1,786,847 | 12/1930 | Hunt . | |
| 1,804,815 | 5/1931 | Schultis . | |
| 1,816,117 | 7/1931 | Kline | 72/87 |
| 3,850,017 | 11/1974 | Fencl et al. | 72/70 |
| 4,164,133 | 8/1979 | Damman . | |
| 4,910,986 | 3/1990 | Funkhouser . | |

*Primary Examiner*—Lowell A. Lawson

*Attorney, Agent, or Firm*—Wallace J. Nelson

[57] ABSTRACT

A bicycle wheel straightener including a support surface, an axle retention bar attached to the support surface and including an axle, adjustable along the length of a slot in the retention bar, for rotatably supporting a bent bicycle wheel in a horizontal relationship relative to the support surface. A pair of spaced rollers are rotatably fixed to the support surface in position to engage and rotatably support a side of the rim of the bicycle wheel. A third roller is positioned between and vertically spaced from the first and second rollers and adjustably supported by a vertical frame member. A jackscrew provides vertical movement of the third roller relative to the first and second spaced rollers to selectively apply pressure to the opposite edge of the bicycle wheel rim supported by the pair of spaced rollers. The jackscrew exerts a straightening force on the wheel rim as the wheel is manually rotated. Two embodiments of the axle retention/adjustment structure are disclosed (FIGS. 3–4 and FIGS. 6–8). FIG. 5 illustrates an alternate embodiment of the wheel straightener support structure including the use of a pair of vertically spaced idler rollers.

12 Claims, 3 Drawing Sheets

BICYCLE WHEEL STRAIGHTENER

FIELD OF THE INVENTION

This invention relates to wheel straighteners in general, and relates specifically to an apparatus and process for straightening bent bicycle wheels.

BACKGROUND OF THE INVENTION

Bicycle wheels are frequently bent due to being run over by automobiles in the driveway, the rider running against a curb or other obstacle, and in various other accidents. Previously, the best solution to straightening minor bends was by adjustment of the wheel spokes. Major bends, if repairable at all, require extensive time and the results are not always effective. Presently, it appears more economically feasible to discard the damaged wheel and replace it with a new one. However, the inability of the repair shop to repair, instead of replacing, the damaged wheel does not always result in complete customer confidence and satisfaction.

It is therefore an object of the present invention to provide an apparatus, requiring a minimum of labor, for economically straightening and recycling bent bicycle wheels.

Another object of the present invention is an adjustable bicycle wheel straightening apparatus for straightening bent bicycle wheels in the 12-28 inch diameter range.

A further object of the present invention is a novel process for straightening bent bicycle wheels.

An additional object of the present invention is an apparatus for applying pressure to both sides of the bent rim of a bicycle wheel for straightening thereof.

SUMMARY OF THE INVENTION

According to the present invention, the foregoing and additional objects of the present invention are attained by providing a horizontally disposed axle retention bar secured to a support surface for supporting a damaged bicycle wheel, in need of being straightened. The damaged wheel is retained in a rotatable, horizontal position and in contact with straightening mechanism also secured to the support surface. The straightening mechanism includes a pair of, or first and second, rollers rotatably supported in spaced, arcuate relationship on the support surface, and in position to permit the edge of the damaged bicycle wheel rim to be in rotatable contact therewith. A third roller, secured to a vertically disposed frame, is positioned between and vertically spaced from the first and second spaced rollers. The third roller is provided with attached adjustment mechanism to adjust the vertical position thereof relative to the pair of spaced rollers.

Vertical height adjustment of the third roller, relative to the pair of spaced rollers is attained, in the preferred embodiment of the present invention, by a jackscrew structure connected thereto. The jackscrew structure permits the third roller to engage, apply and maintain pressure to, the side of the bicycle wheel rim opposite to the side supported by the spaced pair of rollers and thereby effect straightening of the wheel rim as the rim is rotated about its axle.

BRIEF DESCRIPTION OF THE DRAWINGS

A more complete appreciation of the invention and many of the attendant advantages thereof will be more readily apparent as the same becomes better understood by reference to the following detailed description when considered in connection with the accompanying drawings wherein.

DETAILED DESCRIPTION

Figure 1:
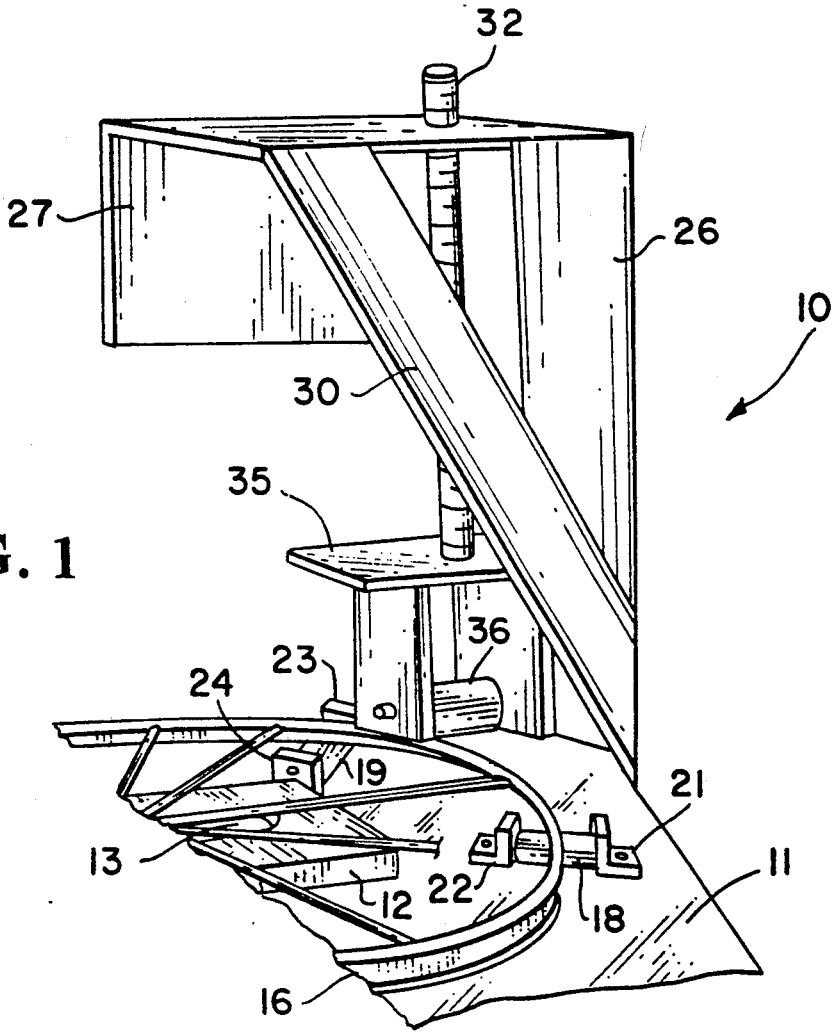
FIG. 1 is a perspective view, with parts omitted and parts broken away, of a specific embodiment of the bicycle wheel straightening apparatus of the present invention.
Figure 2:
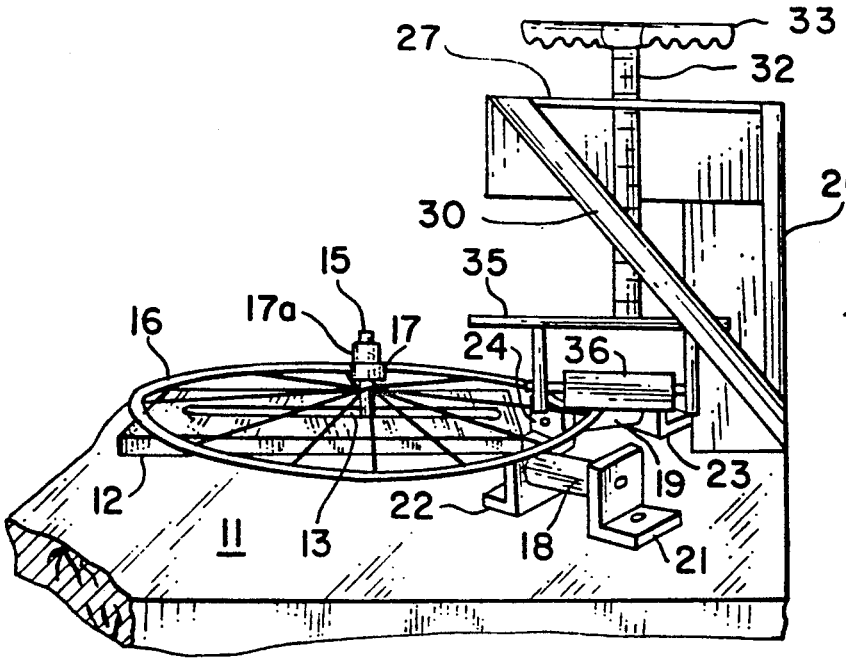
FIG. 2 is a side view of the bicycle wheel straightening apparatus shown in FIG. 1.

Referring now to the drawings and more particularly to FIGS. 1 and 2, the preferred embodiment of the wheel straightening apparatus of the present invention is shown and designated generally by reference numeral 10.

Apparatus 10 includes a table or other horizontal support surface structure 11. An elongated axle retention bar 12 is attached to support surface 11 and is provided with a slot 13 along a portion of the length thereof. Slot 13 serves to adjustably retain one end of an axle 15 for rotatably supporting a bicycle wheel 16. Slot 13 slidably receives axle 15 therein to permit attachment of different size bicycle wheels 16, as will be further explained hereinafter.

A pair of, or first and second, spaced rollers 18,19 are rotatably disposed on support surface 11 in position to permit an edge of the rim of bicycle wheel 16 to be in rotatable contact therewith. First roller 18 is connected to and rotatably supported between a first pair of L-shaped brackets 21,22. Second roller 19 is connected to and rotatably supported by a second pair of L-shaped brackets 23,24. Brackets 21,21 and 23,24 are bolted or otherwise conventionally secured to support surface 11.

A vertical frame structure 26 is provided with an integral horizontally extending arm 27 that extends over at least the portion of support surface 11 having first and second rollers 18,19 thereon. A diagonally disposed brace 30 is attached to horizontally extending arm 27 and vertical frame 26 for support thereof. A jackscrew 32 having a handle 33 is threadingly received through horizontally disposed arm 27 and is secured to a U-frame 35 such that relative rotation is permitted therebetween. A third roller 36 is rotatably supported by U-frame 35 and disposed in vertically spaced relationship substantially intermediate first and second rollers 18,19. Upon rotation of handle 33, jackscrew 32 moves U-frame 35 and third roller 36 to contact and apply pressure to the edge of bicycle wheel 16 on the opposite side of the wheel rim that is in contact with rollers 18,19. Additional rotation of handle 33 causes third roller 36 to apply adjustable pressure to the wheel rim portion disposed between first and second rollers 18,19 and third roller 36. This adjustable pressure is increased adequately to position third roller 36 a vertical distance from first and second rollers 18,19 substantially equal to the width of the rim of bicycle wheel 16 and, thereby effect straightening of the wheel rim where bent, as the bicycle wheel 16 is rotated about axle 15.

Figure 4:
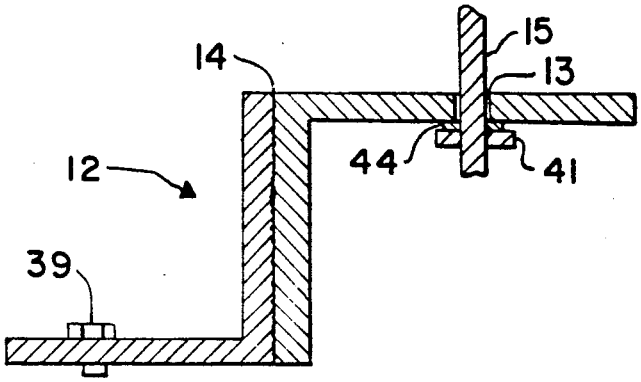
FIG. 4 is sectional view of the axle retention bar shown in FIG. 3 and taken along line IV—IV and illustrating a portion of a bicycle wheel support axle added thereto.
Figure 3:
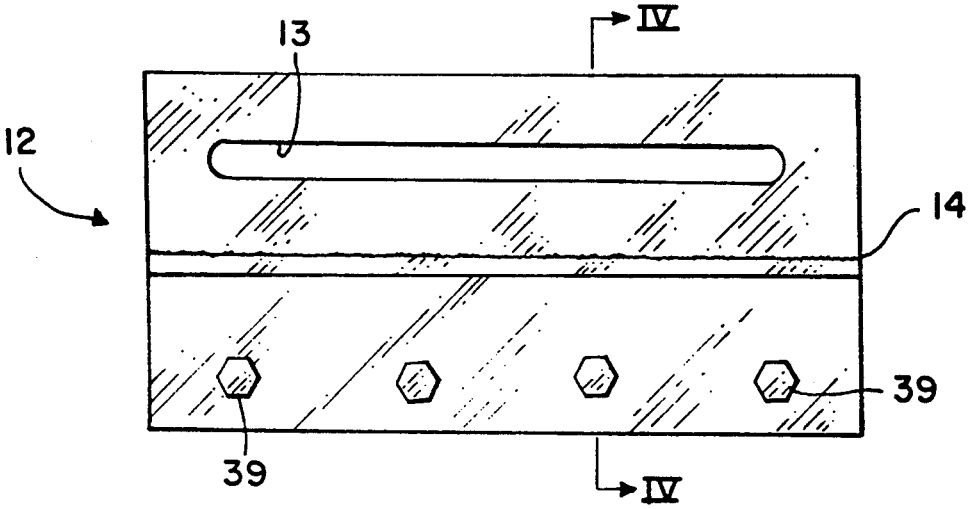
FIG. 3 is a top plan view of one embodiment of the axle retention bar for the bicycle wheel to be straightened by the apparatus shown in FIGS. 1 and 2.

Referring now more particularly to FIGS. 3 and 4, the details of one embodiment of elongated axle retention bar 12 will now be described. In this embodiment, axle retention bar 12 is formed of two elongated angle iron sections joined by welding along the length of opposing legs thereof, as designated by reference numeral 14. In lieu of weld 14, suitable bolts may be employed to connect the angle iron sections, if so desired. One remaining leg of the joined angle iron members is bolted via bolts 39 to support surface 11. The remaining leg of the joined angle iron members is spaced from support surface 11 and is provided with an elongated slot 13 extending along a portion of the length thereof. Slot 13 is of adequate width to slidably receive a conventional bicycle axle 15, (FIG. 4) therethrough. A suitable retention nut 41 is threadingly positioned on axle 15 to fix the position of axle 15 along the length of slot 13 at the desired location for any diameter bicycle wheel 16 to have the rim edge thereof resting on the spaced first and second rollers 18,19. A conventional flat washer 44 is provided between nut 41 and retention bar 12. The bent bicycle wheel 16 is then positioned on axle 15 and secured thereon by a flat washer 17 and nut 17*a* disposed on the opposite end of axle 15 (FIG. 2).

Figure 5:
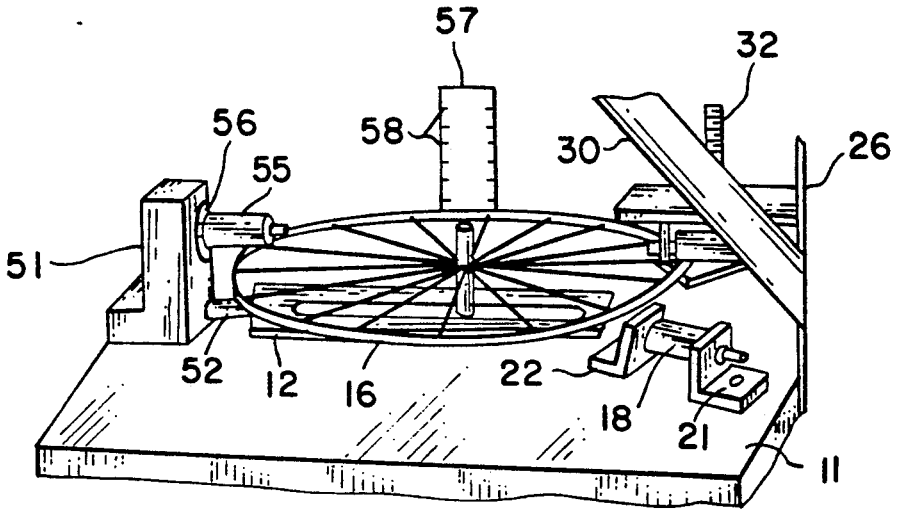
FIG. 5 is a perspective view similar to FIG. 1 and illustrating a modification of the wheel straightening apparatus.

Referring now to FIG. 5, a modification or alternate embodiment of the invention will now be described. In this embodiment, a bracket 51 secured to support surface 11, supports an idler (or fourth) roller 52 extending therefrom and in position to engage the rim edge of a bicycle wheel 16 positioned on axle 15. A top idler (or fifth) roller 55 is also supported by bracket 51 and disposed vertically spaced from roller 52. A slot 56 in bracket 51 receives the axle (not shown) for roller 55 to permit vertical adjustment thereof relative to roller 52 and to permit roller 55 to be placed in engagement with the opposite edge of the rim on bicycle wheel 16 that engages roller 52.

Rollers 52 and 55 may serve as stabilizing structure for any size bicycle wheel 16. When employed, bracket 51 and the rollers 52,55 supported thereby, are offset on a very slight arc from the location of axle retention bar 12 so as to not interfere with, or be interfered by, axle retention bar 12. In lieu of attaching bracket 51 to support surface 11, it could be adjustably attached to the side of retention bar 12 and adjusted along the length thereof to accommodate different size bicycle wheels supported by retention bar 12.

Also shown in the embodiment of FIG. 5 is an optional, vertically disposed, indicator scale 57 that may be employed to assist the operator in using wheel straightener apparatus 10. Vertical scale 57 is attached to support surface 11, or adjacent thereto, such that the horizontal indicia or graduations 58 thereon may be visually aligned with the horizontal plane of wheel rotation as wheel 16 is manually rotated. By observing the position of the wheel rim, relative to graduations 58 on scale 57 and while looking along the horizontal plane of wheel rotation, the operator may initially observe the degree of bend needed to be corrected and observe the straightening results as progressing during wheel rotation. Also, scale 57 permits the operator to observe the need of further "fine tuning" of a wheel 16 being straightened without removal of the wheel from axle retention bar 12.

Figure 6:
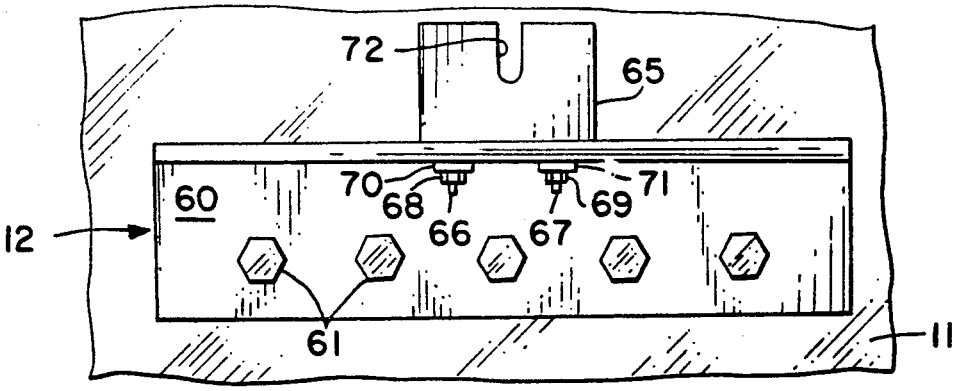
FIG. 6 is a top plan view of another embodiment of the axle retention bar assembly employed in the present invention.
Figure 7:
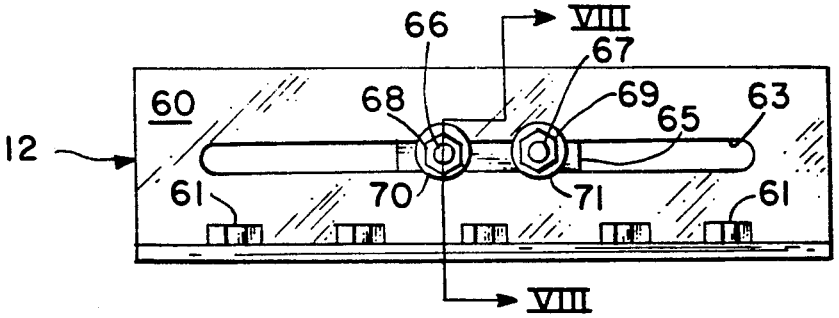
FIG. 7 is a side view of the axle retention bar assembly shown in FIG. 6.
Figure 8:
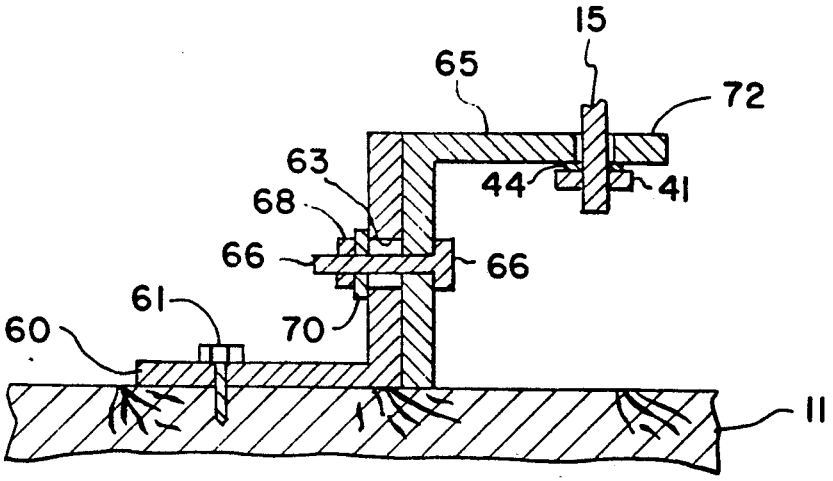
FIG. 8 is a sectional view of the axle retention bar assembly shown in FIGS. 6 and 7 and taken along line VIII—VIII of FIG. 7.

Referring now to FIGS. 6–8, an alternate embodiment for the axle retention bar assembly 12 is shown. In this embodiment the axle retention bar assembly is formed of a single angle iron segment 60 having one leg thereof bolted via bolts 61 to support surface 11. The vertically extending leg of angle iron segment 60 is provided with an elongated slot 63 therethrough and extending along the major portion of the segment length. A bracket 65, formed of a short segment of angle iron, is adjustably positioned along slot 63. One leg of angle iron bracket 65 is bolted to the vertically extending leg of angle iron segment 60 via a pair of bolts 66,67 secured by respective nuts 68,69 and washers 70,71, and leaving an unattached leg extending horizontally over, and spaced from, support surface 11.

Bracket 65 is provided with a cut-out notch, or groove, substantially intermediate the length of the unattached leg thereof, as designated by reference numeral 72. The notch or groove 72 receives axle 15 with flat washer 44 and nut 41 retaining axle 15 in fixed position thereon for receipt of wheel 16, as in the previously described embodiment. Bracket 65 is adjusted along the length of slot 60 by loosening nuts 68,69 and sliding the bracket to the desired location for the specific wheel diameter that is to be positioned on axle 15 for straightening. After tightening of nuts 68,69 the straightening apparatus is ready for use.

The operation of the invention is believed apparent from the above description. The spokes on a bent bicycle wheel 16 are all loosened and wheel 16 secured to an axle 15 that has been adjusted along the length of axle retention bar 12 such that the rim of the wheel rests on rollers 18,19. The direction or placement of the bent portion of a bent bicycle wheel 16 is immaterial to operation of the wheel straightener of the present invention. That is, the bent portion of the wheel may be placed in either the upward or downward direction relative to rollers 18,19 for straightening thereof. After securing the bent wheel 16 on axle 15, handle 33 on jackscrew 32 is manually rotated to cause third roller 36 to engage and apply pressure to the bent rim on the wheel as the wheel is manually rotated to effect straightening thereof. Forced manual rotation of wheel 16 is facilitated by the free turning of each of rollers 18, 19 and 36 about their bearing supports during wheel rotation. As the bent wheel is straightened due to the pressure exerted on any bent portion by each of rollers 18, 19 and 36, handle 33 is adjusted to maintain pressure by third roller 36 on the wheel rim or until the vertical distance between third roller 36 and first and second rollers 18,19 is reduced to be exactly equal to the width of the rim on the wheel being straightened.

The straightening process may require several manual rotations of the wheel to "fine tune" the straightened wheel. After straightening of the bent wheel, the spokes are evenly tightened to maintain straight condition and the wheel is ready to again be installed on the bicycle.

No specific materials have been described for most of the parts of the present invention, it being understood that any material suitable for the purpose may be employed. In the illustrated specific embodiment, support surface 11 is a wooden table having a two inch thickness. Brackets 21,22,23,24 and 51 are formed of one-quarter inch angle iron, and frame structure 26 formed of welded angle iron and one-quarter inch metal plate sections. Each of the rollers 18,19,36,52 and 55 are provided with bearing supports on a suitable axle to ensure easy rotation thereof.

Although the invention has been described relative to specific embodiments thereof, it is not so limited. For example all, or some, of the brackets 21,22,23,24 and 51 may be secured directly to, or to a plate integral with, vertical frame structure 26 and the entire structure attached, as a unit, to support surface 11. Also, suitable legs may be provided on this unit to eliminate the need for the illustrated separate support surface 11. Similarly, vertical frame 26 may be free standing and provided with self supporting legs. With, or without, such legs the vertical frame may also be attached directly to support surface 11, as in the illustrated embodiment. Also, the operation of jackscrew 32 need not depend on the manual handle shown and described, but could be operated by pneumatic, electrical or other conventional drive structure. Structure other than jackscrew 32 could also be employed to exert the needed pressure on third roller 36 to effect straightening of wheel 16 without departing from the spirit and scope of the present invention.

Further, the support surface need not be restricted to a horizontal plane but could be a vertical wall with the wheel plane of rotation being vertical and the support frame and jackscrew disposed on a horizontal plane.

The arcuate distance between rollers 18 and 19 is not deemed critical to the operation of the invention. In the illustrated embodiment, this distance is chosen to be approximately fifteen degrees but a distance of up to forty-five degrees is considered operable for the present invention. The bracket attachments for bracket pairs 21,22 and 23,24 may be designed to adjust the arcuate distance or spacing between first and second rollers 18,19, if so desired.

These and other variations and modifications of the present invention will be readily apparent to those skilled in the art in the light of the above description. It is therefore to be understood that, within the scope of the appended claims, the invention may be practiced other than as specifically described herein.

What is claimed as new and desired to be secured by Letters Patent of the United States is:

1. A bicycle wheel straightener comprising:

a support surface;

adjustment means extending from said support surface to rotatably support a bicycle wheel in a horizontal position relative to said support surface;

first and second spaced rollers rotatably disposed on said support surface and positioned to rotatably support a side of the rim of a bicycle wheel rotatably supported thereon;

a vertical frame member;

a third roller;

said third roller being disposed between and vertically spaced from said first and said second rollers;

said third roller being adjustably supported by said vertical frame member and movable in a vertical direction toward and away from said first and said second spaced rollers and adapted to selectively contact the opposite side of a bicycle wheel rim supported by said first and said second spaced rollers; and means supported by said vertical frame member to selectively move said third roller in a vertical direction relative to said first and said second rollers and thereby apply pressure to the bicycle wheel rim contacting said third roller to exert a straightening force thereon as said bicycle wheel is manually rotated.

2. The bicycle wheel straightener of claim 1 wherein:

said adjustment means includes an elongated, horizontally disposed, axle retention bar secured to said support surface;

an elongated slot extending through and along a substantial length of said elongated axle retention bar;

a bicycle wheel axle slidably disposed within said elongated slot for rotatably supporting a bicycle wheel in a horizontal position relative to said support surface; and means for securing said bicycle wheel axle at the desired location along said elongated slot to position the rim of a bicycle wheel mounted thereon in rotatable contact with said first and said second spaced rollers.

3. The bicycle wheel straightener of claim 1 wherein:

said adjustment means includes a first elongated angle iron segment having one leg thereof secured to said support surface and the other leg vertically extending from said support surface;

an elongated slot provided through and along a substantial length of the leg of said first angle iron segment vertically extending from said support surface;

a bracket formed of a second angle iron segment;

at least one bolt extending through a first leg of said bracket and through said elongated slot to slidably attach said bracket to said first angle iron segment;

a second leg of said bracket being disposed parallel with and spaced from said support surface;

an opening provided through said second leg of said bracket;

a bicycle axle vertically extending through said opening for rotatably supporting the bicycle wheel in a horizontal position relative to said support surface; whereby said at least one bolt extending through one leg of said bracket and said slot in said first angle iron segment permits adjustment of said bracket and the bicycle wheel supported thereby along the length of said elongated slot to permit positioning of the rim of a bicycle wheel having a diameter of 12–28 inches to be mounted thereon in rotatable contact with said first and said second spaced rollers.

4. The bicycle wheel straightener of claim 1 wherein said adjustment means includes an elongated axle retention bar secured to said support surface and wherein said first and said second rollers are disposed on opposite sides of a first end of said elongated axle retention bar;

a bracket secured to said support surface adjacent the second end of said elongated axle retention bar;

a first idler roller rotatably supported by said bracket and disposed in the same horizontal plane as said first and said second rollers, and serving to support the same side of a bicycle wheel rim as that engaged by said first and said second rollers;

a second idler roller rotatably supported by said bracket and vertically disposed from said first idler roller; and said second idler roller being vertically adjustable along said bracket to engage the same side of a bicycle wheel rim as that engaged by said third roller.

5. The bicycle wheel straightener of claim 1 including an indicator scale vertically disposed relative to said support surface; and a plurality of horizontally disposed graduations on said indicator scale; whereby said indicator scale is visible to an operator while looking along the horizontal plane of wheel rotation of said bicycle wheel to provide visual indication of the degree of bend needed to be corrected and to observe the straightening results as progressing during wheel rotation while pressure is being applied by said first, second and third rollers.

6. A bicycle wheel straightener apparatus comprising:

a support surface;

a horizontally disposed axle retention bar secured to said support surface;

said horizontally disposed axle retention bar having a slot extending along a portion of the length thereof;

adjustment means disposed within said slot for supporting a bicycle wheel parallel with said support surface;

said adjustment means facilitating adjustment of the position of said bicycle wheel axle along the length of said slot in said axle retention bar;

first and second spaced rollers rotatably fixed to said support surface and in position to rotatably support one side of the rim of a bicycle wheel rotatably supported by said axle;

a vertical frame supporting a third roller;

said third roller being disposed between and vertically spaced from said first and said second rollers;

said third roller being adjustably supported by said vertical frame member and vertically movable relative to said first and said second spaced rollers and adapted to selectively contact the side of the bicycle wheel rim opposite to the rim side supported by said first and said second spaced rollers; and means supported by said vertical frame member to selectively move said third roller toward said first and said second rollers and thereby apply a pressure to the bicycle wheel rim contacting said third roller to thereby induce straightening thereof as said bicycle wheel is manually rotated.

7. The bicycle wheel straightener apparatus of claim 6 wherein said means supported by said vertical frame member to selectively move said third roller comprises a U-frame having a spindle extending therethrough and said third roller is rotatable supported on said spindle;

a jackscrew having a first end secured to and rotatable relative to said U-frame;

said vertical frame member including a horizontally disposed arm parallel with and spaced from said support surface;

said jackscrew having a second end threadingly extending through and supported by said horizontally disposed arm; and a handle member attached to said second end of said jackscrew to facilitate manual rotation thereof and thereby cause vertical movement of said U-frame and said third roller relative to said first and said second rollers.

8. The bicycle wheel straightener apparatus of claim 6 including an indicator scale vertically disposed adjacent said bicycle wheel supported by said adjustment means; and, a plurality of horizontally disposed spaced graduations on said indicator scale; whereby, an operator of said bicycle wheel straightener apparatus may look along the horizontal plane of rotation of said bicycle wheel to initially observe the degree of bend needed to be corrected and observe the straightening results as said wheel is rotated during the straightening procedure by observing the relative position of said wheel rim and said indicator scale.

9. A method of straightening a bent bicycle wheel comprising the steps of:

providing a support surface;

providing an axle for rotatably supporting a bicycle wheel on and in a horizontal relationship relative to said support surface;

securing a bicycle wheel in need of straightening on the axle;

providing at least a pair of spaced rollers on said support surface in position to support spaced portions of the rim of the bicycle wheel;

providing a third roller substantially intermediate to and vertically spaced from the pair of spaced rollers;

positioning the third roller in a vertical direction relative to the pair of rollers;

moving the third roller so as to engage and apply a vertical pressure to the bicycle rim on the opposite edge thereof from that engaging the pair of rollers;

manually rotating the bicycle wheel to cause the rim portion thereof to rotate along a plane between the pair of rollers and the third roller to thereby induce a straightening force on the bicycle rim in response to the pair of rollers and the third roller;

continuing the movement of the third roller relatively toward the pair of rollers until the vertical distance therebetween is equal to the width of the bicycle wheel; and while maintaining this controlled vertical spacing between the pair of rollers and the third roller, manually rotating the bicycle wheel until the wheel rim is straightened and the wheel may be manually rotated therebetween with little or no resistance.

10. The method of claim 9 including:

providing a second pair of vertically spaced rollers disposed on the support surface and at a substantially 180 degree relationship with said third roller; and prior to the step of manually rotating the wheel, positioning the wheel rim between the second pair of rollers and adjusting the vertical spacing between the second pair of rollers to be essentially equal to the width of the width of the rim on the bicycle wheel being straightened.

11. The method of claim 9 including:

prior to or immediately after the step of securing a bicycle wheel in need of straightening on the axle, adjusting the relative distance the bicycle support axle is from the pair of rollers to compensate for different size bicycle wheels and ensure that the bicycle wheel rim is rotatably supported by the pair of spaced rollers.

12. The method of claim 9 including the steps of providing a vertical indicator scale having a plurality of horizontally disposed graduations thereon adjacent to the bicycle wheel being straightened to give visual indication to an operator, when looking along the horizontal plane of rotation of the bicycle wheel, of the degree of wheel bend to be straightened and to the straightening results as the wheel is rotated under the pressure of the rollers.

* * * * *